US010582298B2

(12) United States Patent
Coffey et al.

(10) Patent No.: US 10,582,298 B2
(45) **Date of Patent: *Mar. 3, 2020**

(54) DIRECTIONAL ACOUSTIC DEVICE AND METHOD OF MANUFACTURING A DIRECTIONAL ACOUSTIC DEVICE

(71) Applicant: Bose Corporation, Framingham, MA (US)

(72) Inventors: Joseph A. Coffey, Hudson, MA (US); Peter C. Santoro, Groton, MA (US); Edwin C. Johnson, Jr., Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 226 days.

This patent is subject to a terminal disclaimer.

(21) Appl. No.: 15/262,355

(22) Filed: Sep. 12, 2016

(65) Prior Publication Data

US 2017/0006377 A1 Jan. 5, 2017

Related U.S. Application Data

(63) Continuation-in-part of application No. 14/674,178, filed on Mar. 31, 2015, now Pat. No. 10,057,701.

(51) Int. Cl.
*H04R 1/02* (2006.01)
*H04R 1/28* (2006.01)
(Continued)

(52) U.S. Cl.
CPC ..... *H04R 1/345* (2013.01); *H04R 1/288* (2013.01); *H04R 31/00* (2013.01); *H04R 31/006* (2013.01); *H04R 1/023* (2013.01); *H04R 2400/11* (2013.01)

(58) Field of Classification Search
CPC ..... H04R 1/345; H04R 1/288; H04R 1/023; H04R 31/00; H04R 2400/11
(Continued)

(56) References Cited

U.S. PATENT DOCUMENTS 4,757,546 A * 7/1988 Akino ..... H04R 1/342 381/357
4,789,044 A * 12/1988 Akino ..... H04R 1/38 181/158
(Continued)

FOREIGN PATENT DOCUMENTS

CN 101198235 A 6/2008
CN 102017654 A 4/2011
(Continued)

OTHER PUBLICATIONS

Office Action dated Oct. 29, 2018 issued by the Japanese Patent Office for Japanese Application No. 2017-550864.
(Continued)

*Primary Examiner* — Forrest M Phillips
(74) *Attorney, Agent, or Firm* — Brian M. Dingman; Dingman IP Law, PC

(57) ABSTRACT

A directional acoustic device with an acoustic source or an acoustic receiver and a conduit to which the acoustic source or acoustic receiver is acoustically coupled and within which acoustic energy travels in a propagation direction from the acoustic source or to the acoustic receiver. The conduit has a radiating portion that has a radiating surface with leak openings that define controlled leaks through which acoustic energy radiated from the source into the conduit can leak to the outside environment or through which acoustic energy in the outside environment can leak into the conduit. The radiating surface has a thin sheet with openings through the sheet, and a cover material with a greater acoustic resistance than an acoustic resistance of an opening. The cover material
(Continued)

covers at least parts of at least some of the openings, to define controlled acoustic leaks into or out of the conduit.

20 Claims, 13 Drawing Sheets

(51) Int. Cl.
*H04R 1/34* (2006.01)
*H04R 31/00* (2006.01)

(58) Field of Classification Search
USPC ..... 181/196
See application file for complete search history.

(56) References Cited

U.S. PATENT DOCUMENTS

| | | | | |
|---|---|---|---|---|
| 6,079,515 | A * | 6/2000 | Newman | H04R 1/02 181/156 |
| 6,158,902 | A | 12/2000 | Staat | |
| 6,973,994 | B2 * | 12/2005 | Mackin | H04R 1/00 181/145 |
| 9,451,355 | B1 * | 9/2016 | Jankovsky | H04R 1/345 |
| 10,057,701 | B2 * | 8/2018 | Jankovsky | H04R 31/00 |
| 2006/0222196 | A1 | 10/2006 | Uchimura | |

FOREIGN PATENT DOCUMENTS

| | | | |
|---|---|---|---|
| JP | 61-212198 | | 9/1986 |
| JP | 62-118697 | | 5/1987 |
| JP | 3-204298 | | 9/1991 |
| JP | 6-105386 | | 4/1994 |
| JP | 9-149487 | | 6/1997 |
| JP | 11-136787 | | 5/1999 |
| JP | 11234784 | A | 8/1999 |
| JP | 2007-27413 | | 10/2007 |
| JP | 2008258998 | A | 10/2008 |
| JP | 2009-65609 | | 3/2009 |
| JP | 2011053395 | A | 3/2011 |

OTHER PUBLICATIONS

Office Action dated Jan. 22, 2019 issued by the China National Intellectual Property Administration for Chinese Patent Application No. 201680020629X.
English translation of Office Action dated Jan. 22, 2019 issued by the China National Intellectual Property Administration for Chinese Patent Application No. 201680020629X.
Search Report issued by the China National Intellectual Property Administration for Chinese Patent Application No. 201680020629X.
Office Action dated Nov. 4, 2019 from the China National Intellectual Property Administration issued for Chinese Patent Application No. 201680090407.5.
English Machine Translation of Office Action dated Nov. 4, 2019 from the China National Intellectual Property Administration issued for Chinese Patent Application No. 201680090407.5.

* cited by examiner

DIRECTIONAL ACOUSTIC DEVICE AND METHOD OF MANUFACTURING A DIRECTIONAL ACOUSTIC DEVICE

CROSS-REFERENCE TO RELATED APPLICATION

This application is a continuation in part of and claims priority to application 14/674,178 entitled "Method of Manufacturing a Loudspeaker" filed on Mar. 31, 2015.

BACKGROUND

This disclosure relates to a directional acoustic device and methods for manufacturing a directional acoustic device.

Acoustic devices include loudspeakers and microphones. Loudspeakers generally include a diaphragm and a linear motor. When driven by an electrical input signal, the linear motor moves the diaphragm to cause vibrations in air, thereby generating sound. Various techniques have been used to control the directivity and radiation pattern of a loudspeaker, including acoustic horns, pipes, slots, waveguides, and other structures that redirect or guide the generated sound waves. In some of these loudspeaker structures, an opening in the horn, pipe, slot or waveguide is covered with an acoustically resistive material to improve the performance of the loudspeaker over a wider range of frequencies, e.g., to increase the directionality of the loudspeaker. Microphones can have one or more microphone elements that receive sound instead of a diaphragm and linear motor that generate sound.

SUMMARY

In general, in some aspects a method for manufacturing a loudspeaker includes creating a dual-layered fabric having an acoustic resistance by attaching a first fabric having a first acoustic resistance to a second fabric having a second acoustic resistance lower than the first acoustic resistance. The method further includes applying a coating material to a first portion of the dual-layered fabric. The coating material forms a pattern on the first portion of the dual-layered fabric that changes the acoustic resistance of the dual-layered fabric along at least one of: a length and radius of the dual-layered fabric.

Implementations may include any, all or none of the following features. The first acoustic resistance may be approximately 1,000 Rayls. The first fabric may be a monofilament fabric. The second fabric may be a monofilament fabric. The first fabric may be attached to the second fabric using at least one of: a solvent and an adhesive.

Applying a coating material to a first portion of the dual-layered fabric may include masking a second portion of the dual-layered fabric, the second portion being adjacent to the first portion. Applying a coating material to a first portion of the dual-layered fabric may further include applying the coating material to an unmasked portion of the dual-layered fabric. Applying a coating material to a first portion of the dual-layered fabric may include selectively depositing the coating material to form the pattern on the first portion of the dual-layered fabric. Applying a coating material to a first portion of the dual-layered fabric may include attaching a pre-cut sheet of material to the first portion of the dual-layered fabric. The coating material may include at least one of: paint, an adhesive, and a polymer.

The method may further include thermoforming the dual-layered fabric into at least one of: a spherical shape, a semi-spherical shape, a conical shape, a toroidal shape, and a shape comprising a section of a sphere, cone or toroid.

The method may further include attaching the dual-layered fabric to an acoustic waveguide.

The method may further include attaching an electro-acoustic driver to the acoustic waveguide.

In general, in some aspects a method of manufacturing a loudspeaker includes providing a fabric having an acoustic resistance and applying a coating material to a first portion of the fabric. The coating material forms a pattern on the first portion of the fabric that changes the acoustic resistance of the fabric along at least one of: a length and radius of the fabric.

Implementations may include any, all or none of the following features. The acoustic resistance may be approximately 1,000 Rayls. The fabric may include a monofilament fabric.

Applying a coating material to a first portion of the fabric may include masking a second portion of the fabric, the second portion being adjacent to the first portion. Applying a coating material to a first portion of the fabric may further include applying the coating material to an unmasked portion of the fabric. Applying a coating material to a first portion of the fabric may include selectively depositing the coating material to form the pattern on the first portion of the fabric. Applying a coating material to a first portion of the fabric may include attaching a pre-cut sheet of material to the first portion of the fabric. The coating material may include at least one of: paint, an adhesive, and a polymer.

The method may further include thermoforming the fabric into at least one of: a spherical shape, a semi-spherical shape, a conical shape, a toroidal shape, and a shape comprising a section of a sphere, cone or toroid.

The method may further include attaching the fabric to an acoustic waveguide.

The method may further include attaching an electro-acoustic driver to the acoustic waveguide.

In general, in some aspects a method of manufacturing a loudspeaker includes creating a dual-layered fabric having an acoustic resistance by attaching a first fabric having a first acoustic resistance to a second fabric having a second acoustic resistance lower than the first resistance. The method further includes altering the acoustic resistance of the dual-layered fabric along at least one of: a length and radius of the dual-layered fabric by fusing a first portion of the dual-layered fabric to form a substantially opaque pattern on the first portion of the dual-layered fabric.

Implementations may include any, all or none of the following features. The first acoustic resistance may be approximately 1,000 Rayls. The first fabric and the second fabric may each include a monofilament fabric. The first fabric may be attached to the second fabric using at least one of: a solvent and an adhesive. Fusing a first portion of the dual-layered fabric may include heating the dual-layered fabric.

The method may further include thermoforming the dual-layered fabric into at least one of: a spherical shape, a semi-spherical shape, a conical shape, a toroidal shape, and a shape comprising a section of a sphere, cone or toroid.

The method may further include attaching the dual-layered fabric to an acoustic waveguide.

The method may further include attaching an electro-acoustic driver to the acoustic waveguide.

In general, in some aspects a directional acoustic device includes an acoustic source or an acoustic receiver, and a conduit to which the acoustic source or acoustic receiver is acoustically coupled and within which acoustic energy travels in a propagation direction from the acoustic source or to the acoustic receiver. The conduit has a radiating portion that has a radiating surface with leak openings that define controlled leaks through which acoustic energy radiated from the source into the conduit can leak to the outside environment or through which acoustic energy in the outside environment can leak into the conduit. The radiating surface comprises a thin sheet with a plurality of openings through the sheet, and a cover material with a greater acoustic resistance than an acoustic resistance of an opening, where the cover material covers at least parts of at least some of the openings, to define a plurality of controlled acoustic leaks into or out of the conduit.

Implementations may include any, all or none of the following features. The cover material may be an open weave material, such as a fabric material. The open weave material may have an acoustic resistance of approximately 1,000 Rayls. The cover material may have an acoustic resistance of approximately 1,000 Rayls. The thin sheet may be substantially acoustically opaque.

Implementations may include any, all or none of the following features. The thin sheet may comprise a plastic sheet, which may be a polycarbonate material. The thin sheet may have a generally circular segment shape. At least same of the openings through the sheet may be generally arc-shaped. The thin sheet may comprise a plurality of generally arc-shaped support ribs. The thin sheet may have a width, and at least some of the support ribs may extend across at least most of the width.

Implementations may include any, all or none of the following features. The cover material may be adhered to the thin sheet, for example with a pressure-sensitive adhesive. The cover material may fully cover all of the openings through the sheet. The radiating surface may be mounted to the conduit such that the radiating surface defines an outer surface of the directional acoustic device. The cover material may be in tension.

In general, in some aspects a directional acoustic device includes an acoustic source or an acoustic receiver, and a conduit to which the acoustic source or acoustic receiver is acoustically coupled and within which acoustic energy travels in a propagation direction from the acoustic source or to the acoustic receiver. The conduit has a radiating portion that has a radiating surface with leak openings that define controlled leaks through which acoustic energy radiated from the source into the conduit can leak to the outside environment or through which acoustic energy in the outside environment can leak into the conduit. The radiating surface comprises a thin acoustically opaque plastic sheet with a top and bottom surface and plurality of openings through the sheet from the top to the bottom surface, and an open weave fabric cover material with a greater acoustic resistance than an acoustic resistance of an opening adhered to the top or bottom surface of the sheet and fully covering at least most of the openings, to define a plurality of controlled acoustic leaks into or out of the conduit. The cover material may essentially fully cover the top or bottom surface of the sheet.

Implementations may include one of the above and/or below features, or any combination thereof. Other features and advantages will be apparent from the description and the claims.

BRIEF DESCRIPTION OF THE DRAWINGS

For purposes of illustration some elements are omitted and some dimensions are exaggerated. For ease of reference, like reference numbers indicate like features throughout the referenced drawings.

DETAILED DESCRIPTION

Figure 1A:
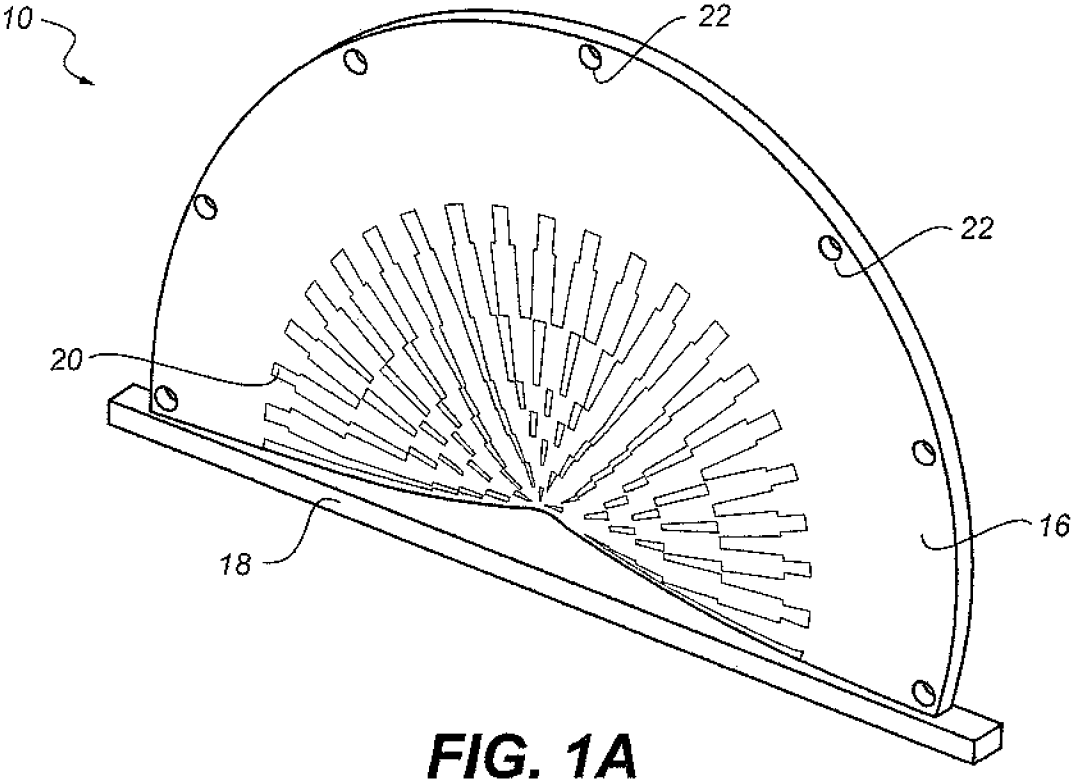
FIG. 1A is perspective view of a loudspeaker.
Figure 1B:
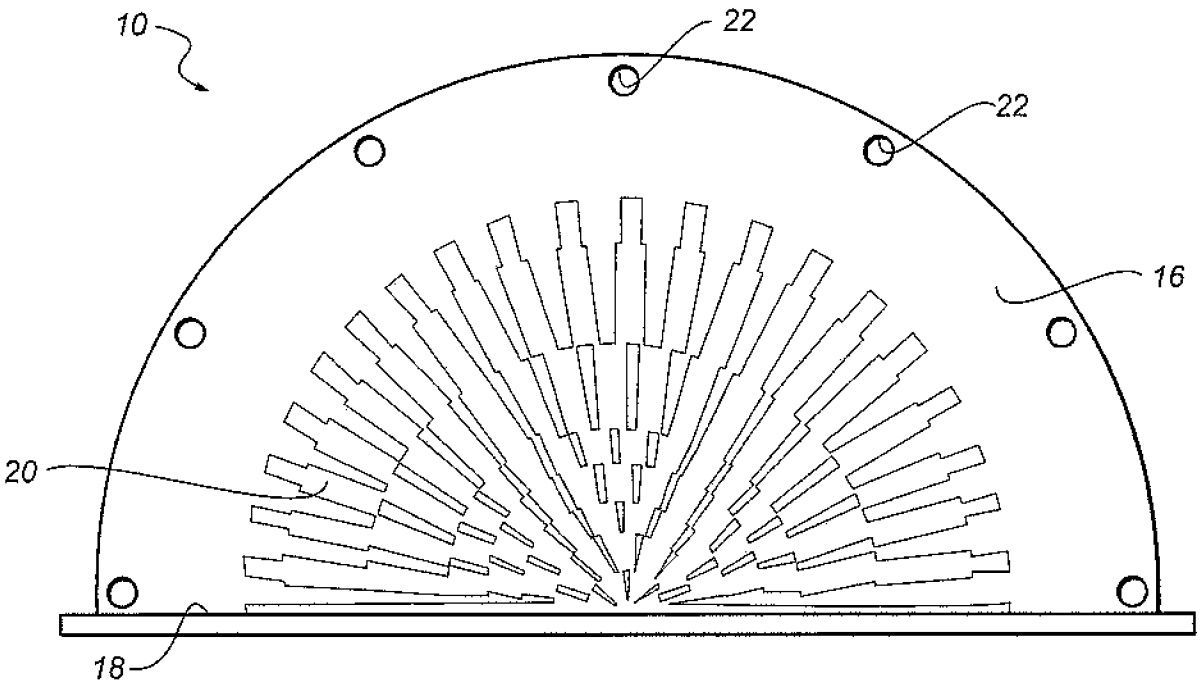
FIG. 1B is front view of the loudspeaker of FIG. 1A.
Figure 1C:
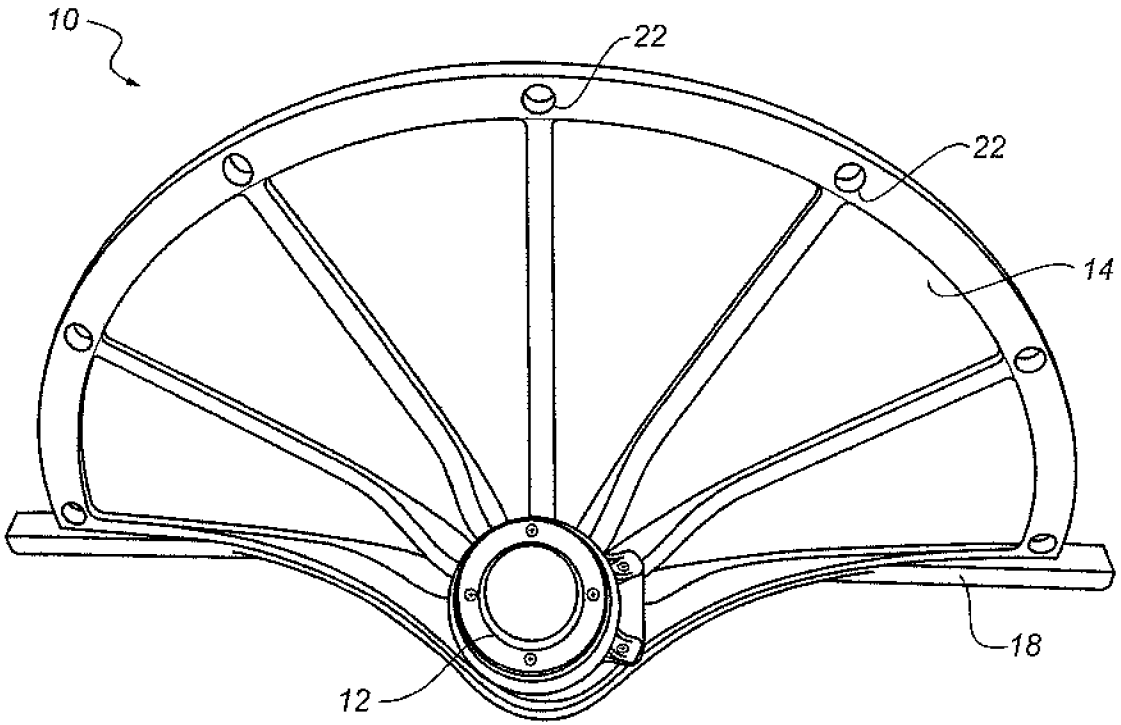
FIG. 1C is a back view of the loudspeaker of FIG. 1A.

A loudspeaker 10, shown in FIGS. 1A through 1C, includes an electro-acoustic driver 12 coupled to an acoustic waveguide 14. The acoustic waveguide 14 is coupled to a resistive screen 16, on which an acoustically resistive pattern 20 is applied. The acoustically resistive pattern 20 may be a substantially opaque and impervious layer that is applied to or generated on the resistive screen 16. The electro-acoustic driver 12, acoustic waveguide 14, and resistive screen 16 together may be mounted onto a base section 18. The base section 18 may be formed integrally with the acoustic waveguide 14 or may be formed separately. The loudspeaker 10 may also include a plurality of mounting holes 22 for mounting the loudspeaker 10 in, for example, a ceiling, wall, or other structure. One such loudspeaker 10 is described in U.S. patent application Ser. No. 14/674,072, titled "Directional Acoustic Device" filed on Mar. 31, 2015, the entire contents of which are incorporated herein by reference.

The electro-acoustic driver 12 typically includes a motor structure mechanically coupled to a radiating component, such as a diaphragm, cone, dome, or other surface. Attached to the inner edge of the cone may be a dust cover or dust cap, which also may be dome-shaped. In operation, the motor structure operates as a linear motor, causing the radiating surface to vibrate along an axis of motion. This movement causes changes in air pressure, which results in the production of sound. The electro-acoustic driver 12 may be a mid-high or high frequency driver, typically having an operating range of 200 Hz to 16 kHz. The electro-acoustic driver 12 may be of numerous types, including but not limited to a compression driver, cone driver, mid-range driver, full-range driver, and tweeter. Although one electro-acoustic driver is shown in FIGS. 1A through 1C, any number of drivers could be used. In addition, the one or more electro-acoustic drivers 12 could be coupled to the acoustic waveguide 14 via an acoustic passage or manifold component, such as those described in U.S. Patent Publication No. 2011-0064247, the entire contents of which are incorporated herein by reference.

The electro-acoustic driver 12 is coupled to an acoustic waveguide 14 which, in the example of FIGS. 1A through 1C, guides the generated sound waves in a radial direction away from the electro-acoustic driver 12. The loudspeaker 10 could be any number of shapes, including but not limited to circular, semi-circular, spherical, semi-spherical, conical, semi-conical, toroidal, semi-toroidal, rectangular, and a shape comprising a section of a circle, sphere, cone, or torpid. In examples where the loudspeaker 10 has a non-circular or non-spherical shape, the acoustic waveguide 14 guides the generated sound waves in a direction away from the electro-acoustic driver 12. The acoustic waveguide 14 may be constructed of a metal or plastic material, including but not limited to thermoset polymers and thermoplastic polymer resins such as polyethylene terephthalate (PET), polypropylene (PP), and polyethylene (PE). Moreover, fibers of various materials, including fiberglass, may be added to the polymer material for increased strength and durability. The acoustic waveguide 14 could have a substantially solid structure, as shown in FIGS. 1A through 1C, or could have hollow portions, for example a honeycomb structure.

Before the generated sound waves reach the external environment, they pass through a resistive screen 16 coupled to an opening in the acoustic waveguide 14. The resistive screen 16 may include one or more layers of a mesh material or fabric. In some examples, the one or more layers of material or fabric may each be made of monofilament fabric (i.e., a fabric made of a fiber that has only one filament, so that the filament and fiber coincide). The fabric may be made of polyester, though other materials could be used, including but not limited to metal, cotton, nylon, acrylic, rayon, polymers, aramids, fiber composites, and/or natural and synthetic materials having the same, similar, or related properties, or a combination thereof. In other examples, a multifilament fabric may be used for one or more of the layers of fabric.

In one example, the resistive screen 16 is made of two layers of fabric, one layer being made of a fabric having a relatively high acoustic resistance compared to the second layer. For example, the first fabric may have an acoustic resistance ranging from 200 to 2,000 Rayls, while the second fabric may have an acoustic resistance ranging from 1 to 90 Rayls. The second layer may be a fabric made of a coarse mesh to provide structural integrity to the resistive screen 16, and to prevent movement of the screen at high sound pressure levels. In one example, the first fabric is a polyester-based fabric having an acoustic resistance of approximately 1,000 Rayls (e.g., Saatifil® Polyester PES 10/3 supplied by Saati of Milan, Italy) and the second fabric is a polyester-based fabric made of a coarse mesh (e.g., Saatifil® Polyester PES 42/10 also supplied by Saati of Milan, Italy). In other examples, however, other materials may be used. In addition, the resistive screen 16 may be made of a single layer of fabric or material, such as a metal-based mesh or a polyester-based fabric. And in still other examples, the resistive screen 16 may be made of more than two layers of material or fabric. The resistive screen 16 may also include a hydrophobic coating to make the screen water-resistant.

The resistive screen 16 also includes an acoustically resistive pattern 20 that is applied to or generated on the surface of the resistive screen 16. The acoustically resistive pattern 20 may be a substantially opaque and impervious layer. Thus, in the places where the acoustically resistive pattern 20 is applied, it substantially blocks the holes in the mesh material or fabric, thereby creating an acoustic resistance that varies as the generated sound waves move radially outward through the resistive screen 16 (or outward in a linear direction for non-circular and non-spherical shapes). For example, where the acoustic resistance of the resistive screen 16 without the acoustically resistive pattern 20 is approximately 1,000 Rayls over a prescribed area, the acoustic resistance of the resistive screen 16 with the acoustically resistive pattern 20 may be approximately 10,000 Rayls over an area closer to the electro-acoustic driver 12, and approximately 1,000 Rayls over an area closer to the edge of the loudspeaker 10 (e.g., in areas that do not include the acoustically resistive pattern 20). The size, shape, and thickness of the acoustically resistive pattern 20 may vary, and just one example is shown in FIGS. 1A through 1C.

The material used to generate the acoustically resistive pattern 20 may vary depending on the material or fabric used for the resistive screen 16. In the example where the resistive screen 16 comprises a polyester fabric, the material used to generate the acoustically resistive pattern 20 may be paint (e.g., vinyl paint), or some other coating material that is compatible with polyester fabric. In other examples, the material used to generate the acoustically resistive pattern 20 may be an adhesive or a polymer. In still other examples, rather than add a coating material to the resistive screen 16, the acoustically resistive pattern 20 may be generated by transforming the material comprising the resistive screen 16, for example by heating the resistive screen 16 to selectively fuse the intersections of the mesh material or fabric, thereby substantially blocking the holes in the material or fabric.

Figure 2:
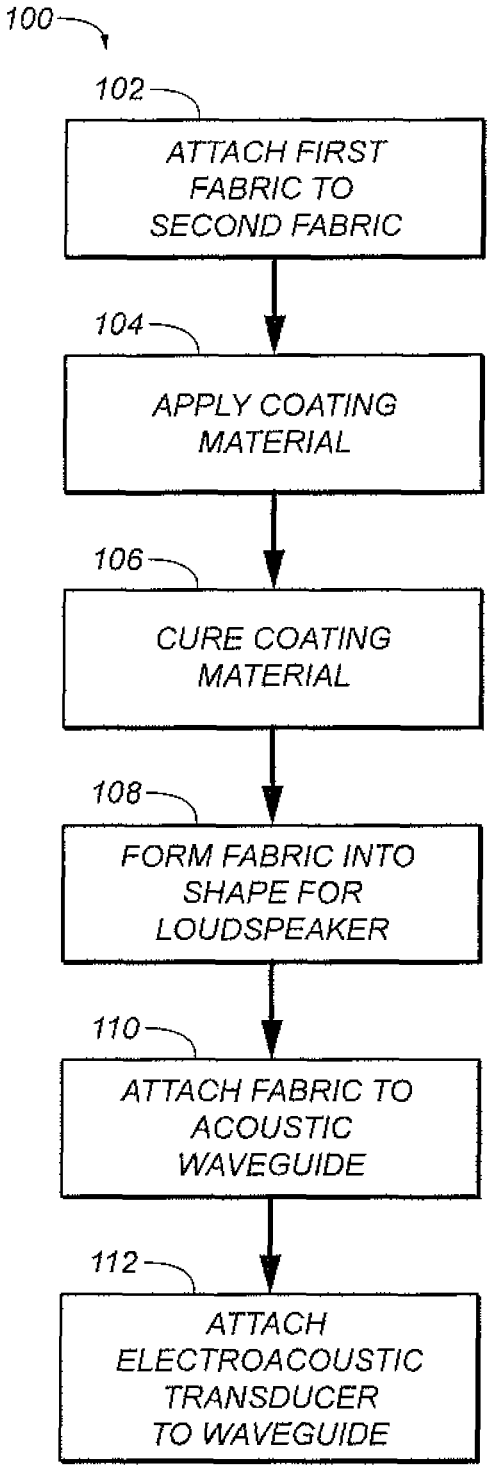
FIG. 2 shows a flow chart of a method for manufacturing the loudspeaker of FIGS. 1A through 1C.

FIG. 2 shows a flow chart of a method 100 for manufacturing the loudspeaker 10 of FIGS. 1A through 1C in the example where the resistive screen 16 is made of two layers of fabric, and a coating material is applied to the resistive screen 16 to form the acoustically resistive pattern 20. Although steps 102-112 of FIG. 2 are shown as occurring in a certain order, it should be readily understood that the steps 102-112 could occur in a different order than is shown. Moreover, although steps 102-112 of FIG. 2 are shown as occurring separately, it should be readily understood that certain of the steps could be combined and occur at the same time. As shown in FIG. 2, to begin formation of the resistive screen 16, a first fabric is attached to a second fabric in step 102. The two fabrics may be attached by, for example, using a layer of solvent, adhesive, or glue that joins the two layers of fabric. Alternatively, the fabrics may be heated to a temperature that permits the two fabrics to be joined to each other. For example, the fabrics may be placed in mold that heats the fabrics to a predetermined temperature for a predetermined length of time until the fabrics adhere to each other, or a laser (or other heat-applying apparatus) may be used to selectively apply heat to portions of the fabrics until those portions adhere to each other. Alternatively, the fabrics could be joined by thermoforming, pressure forming and/or vacuum forming the fabrics.

Figure 6:
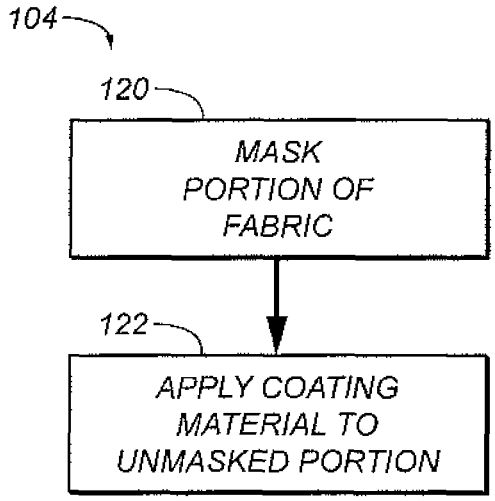
FIG. 6 shows a flow chart of a step that may be used in the methods for manufacturing shown in FIGS. 2 and 3.

In step 104, a coating material (such as paint, an adhesive or a polymer) is applied to the resistive screen 16 to form the acoustically resistive pattern 20. In one example, as shown in FIG. 6, the coating material could be applied using a mask. In that example, a portion of the fabric could be masked (in step 120), and the coating material could be applied to the unmasked portion of the fabric (in step 122), by, for example, spraying or otherwise depositing the coating material onto the unmasked portion of the fabric. In some examples, after the mask has been applied, a coating material (e.g., adhesive beads or polymer beads) could be deposited on the unmasked portion of the fabric, and then melted onto the fabric via the application of heat. The coating material could be applied to the resistive screen 16 using other methods besides a mask, however. For example, the coating material could be pre-cut (for example, using a laser cutter or die cutter), and could then be ironed-on to the fabric or attached using an adhesive. For example, the coating material could comprise a sheet of polymer plastic, metal, paper, or any substantially opaque material having the same, similar, or related properties (or any combination thereof) that is pre-cut into the desired acoustically resistive pattern 20. The sheet could then be attached to the fabric via the application of heat or an adhesive. In yet another example, the coating material could be deposited directly onto the fabric, using a machine that can draw out the desired pattern 20, thereby selectively applying the coating material only to the portion of the fabric that should have the acoustically resistive pattern 20. In addition, the coating material could be applied to the resistive screen 16 using other known methods, including but not limited to a silk-screen, spray paint, ink jet printing, etching, melting, electrostatic coating, or any combination thereof.

Optionally, in step 106, the coating material may be cured, by, for example, baking the assembly at a predetermined temperature, applying ultraviolet (UV) light to the coating material, exposing the coating material to the air, or any combination thereof. If a coating material is selected that does not need to be cured, step 106 would be omitted. In some examples, steps 102, 104 and 106 could be combined into a single step. For example, the first and second layers of fabric could be placed on top of each other, and a UV-curable adhesive could be deposited onto one layer of the fabric in the desired acoustically resistive pattern 20. The adhesive could then be cured via the application of UV light, which would also result in adhering the two layers of fabric.

In step 108, the fabric is formed into the desired shape for the loudspeaker 10. For example, the fabric may be formed to be a semi-circle, circle, sphere, semi-sphere, rectangle, cone, toroid, or a shape comprising a section of a circle, sphere, cone, toroid and/or rectangle. The loudspeaker 10 may also be bent and/or curved along its length, as described, for example, in U.S. Pat. No. 8,351,630, the entire contents of which are incorporated herein by reference. These various shapes may be created by thermoforming the fabric (i.e., heating it to a pliable forming temperature and then forming it to a specific shape in a mold) and/or vacuum or pressure forming the fabric. Although FIG. 2 shows step 108 as occurring after the coating material has been applied to the resistive screen 16, in other examples, the fabric could be formed into the desired shape before the coating material is applied. Moreover, step 108 could be combined with step 102, so that the forming process also joins the two layers of fabric.

In step 110, the resistive screen 16 is attached to the acoustic waveguide 14 via an adhesive, double-sided tape, a fastener (e.g., a screw, bolt, clamp, clasp, clip, pin or rivet), or other known methods. And in step 112, the electro-acoustic driver 12 is attached to the acoustic waveguide 14. The electro-acoustic driver 12 could be secured to the acoustic waveguide 14 via a fastener or other known methods. Although FIG. 2 shows step 112 as occurring after the fabric has been attached to the acoustic waveguide, in other examples, the electro-acoustic transducer could be attached to the waveguide before the fabric is attached. The acoustic waveguide 14 could be constructed via compression molding, injection molding, plastic machining, or other known methods.

Figure 3:
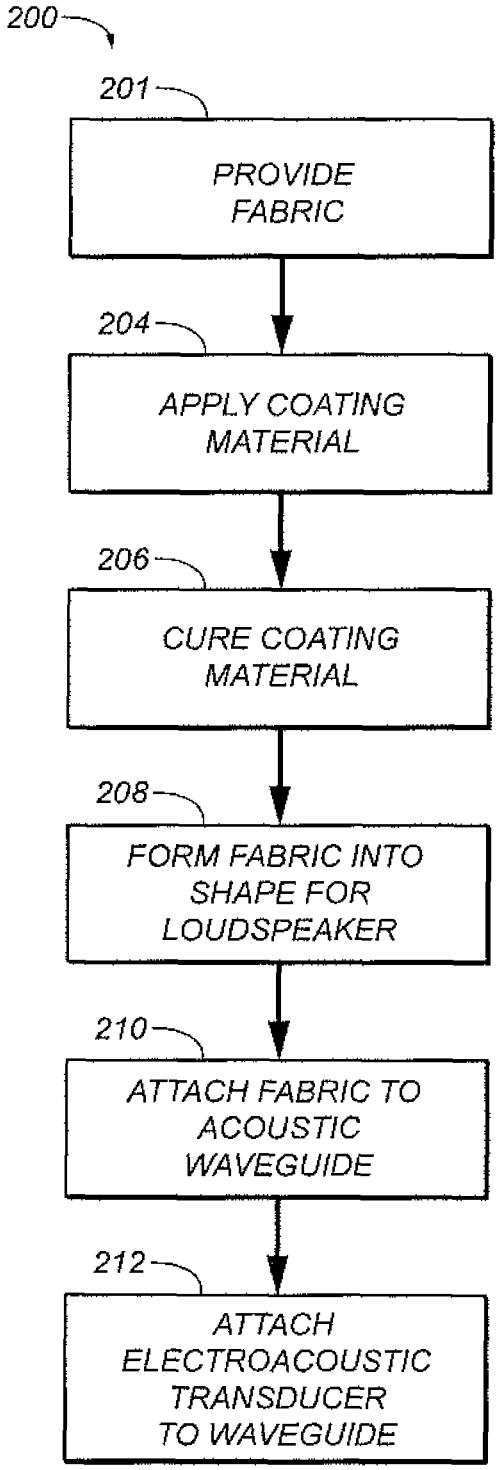
FIG. 3 shows a flow chart of an alternative method for manufacturing the loudspeaker of FIGS. 1A through 1C.

FIG. 3 shows a flow chart of an alternative method 200 for manufacturing the loudspeaker 10 of FIGS. 1A through 1C in the example where the resistive screen 16 is made of a single layer of fabric, and a coating material is applied to the resistive screen 16 to form the acoustically resistive pattern 20. Although steps 201-212 of FIG. 3 are shown as occurring in a certain order, it should be readily understood that the steps 201-212 could occur in a different order than is shown. Moreover, although steps 201-212 of FIG. 2 are shown as occurring separately, it should be readily understood that certain of the steps could be combined and occur at the same time. As shown in FIG. 3, to begin formation of the resistive screen 16, a fabric is provided in step 201. In step 204, a coating material (such as paint, an adhesive or a polymer) is applied to the fabric to form the acoustically resistive pattern 20. The coating material could be applied using the methods previously described in connection with FIG. 2 (e.g., via a mask, a pre-cut sheet of material, by depositing the coating material directly onto the fabric in the desired pattern 20, or via a silkscreen, spray paint, ink jet printing, etching, melting, electrostatic coating, or any combination thereof).

Optionally, in step 206, the coating material may be cured, by, for example, the methods previously described in connection with FIG. 2 (e.g., baking the assembly at a predetermined temperature, applying UV light to the coating material, exposing the coating material to the air, or any combination thereof). If a coating material is selected that does not need to be cured, step 206 would be omitted. As with the example shown in FIG. 2, steps 201, 204 and 206 could be combined into a single step.

In step 208, the fabric is formed into the desired shape for the loudspeaker 10. As with the example of FIG. 2, the fabric may be formed to be a semi-circle, circle, sphere, semi-sphere, rectangle, cone, toroid, or a shape comprising a section of a circle, sphere, cone, toroid and/or rectangle. The loudspeaker 10 may also be bent and/or curved along its length, as described, for example, in U.S. Pat. No. 8,351,630. These various shapes may be created by thermoforming the fabric (i.e., heating it to a pliable forming temperature and then forming it to a specific shape in a mold) and/or vacuum or pressure forming the fabric. Although FIG. 3 shows step 208 as occurring after the coating material has been applied to the resistive screen 16, in other examples, the fabric could be formed into the desired shape before the coating material is applied.

As with the example of FIG. 2, in step 210, the resistive screen 16 is attached to the acoustic waveguide 14 via an adhesive, double-sided tape, a fastener (e.g., a screw, bolt, clamp, clasp, clip, pin or rivet) or other known methods; and in step 212, the electro-acoustic driver 12 is attached to the acoustic waveguide 14 via a fastener or other known methods. Although FIG. 3 shows step 212 as occurring after the fabric has been attached to the acoustic waveguide, in other examples, the electro-acoustic transducer could be attached to the waveguide before the fabric is attached. As with the example of FIG. 2, the acoustic waveguide 14 could be constructed via compression molding, injection molding, plastic machining, or other known methods.

Figure 4:
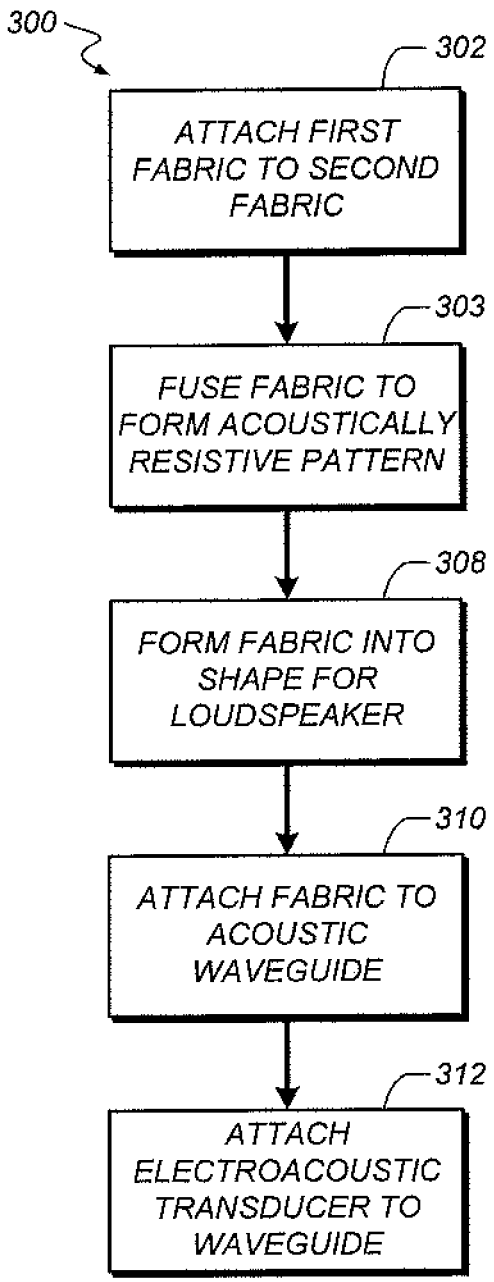
FIG. 4 shows a flow chart of an alternative method for manufacturing the loudspeaker of FIGS. 1A through 1C.

FIG. 4 shows a flow chart of an alternative method 300 for manufacturing the loudspeaker 10 of FIGS. 1A through 1C in the example where the resistive screen 16 is made of two layers of fabric, and the acoustically resistive pattern 20 is formed by fusing the intersections of the fabric, thereby substantially blocking the holes in the fabric. Although steps 302-312 of FIG. 4 are shown as occurring in a certain order, it should be readily understood that the steps 302-312 could occur in a different order than is shown. Moreover, although steps 302-312 of FIG. 4 are shown as occurring separately, it should be readily understood that certain of the steps could be combined and occur at the same time. As shown in FIG. 4, to begin formation of the resistive screen 16, a first fabric is attached to a second fabric in step 302. The first fabric could be attached to the second fabric using the methods previously described in connection with FIG. 2 (e.g., via a layer of solvent, adhesive or glue, or via heating, thermoforming, pressure forming, vacuum forming, or any combination thereof).

In step 303, the fabric is fused to form the acoustically resistive pattern 20, such that the holes in the fabric are substantially blocked, thereby creating a substantially opaque and impervious layer on the fabric. The fabric could be fused by, for example, applying heat to the portions of the fabric that should have the acoustically resistive pattern 20, or by selectively applying chemical bonding elements to the portions of the fabric that should have the acoustically resistive pattern 20.

As with the examples of FIGS. 2 and 3, in step 308, the fabric is formed into the desired shape for the loudspeaker 10 (e.g., via thermoforming, vacuum forming and/or pressure forming); in step 310, the resistive screen 16 is attached to the acoustic waveguide 14; and in step 312, the electro-acoustic driver 12 is attached to the acoustic waveguide 14. These steps could be completed using the methods previously described in connection with FIGS. 2 and 3.

Figure 5:
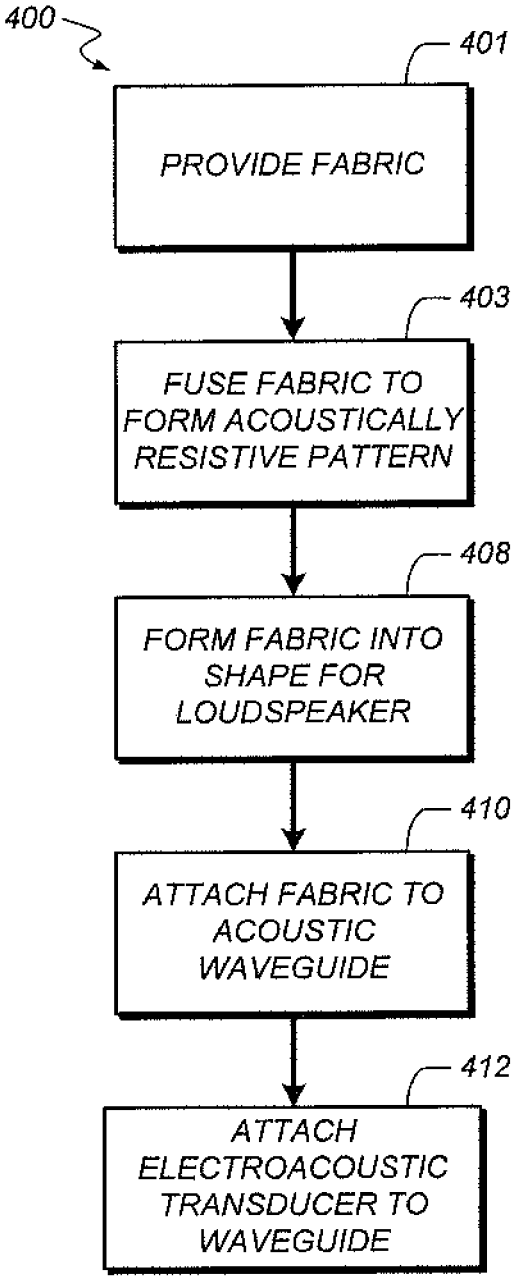
FIG. 5 shows a flow chart of an alternative method for manufacturing the loudspeaker of FIGS. 1A through 1C

FIG. 5 shows a flow chart of an alternative method 400 for manufacturing the loudspeaker 10 of FIGS. 1A through 1C in the example where the resistive screen 16 is made of a single layer of fabric, and the acoustically resistive pattern 20 is formed by fusing the intersections of the fabric, thereby substantially blocking the holes in the fabric. Although steps 401-412 of FIG. 5 are shown as occurring in a certain order, it should be readily understood that the steps 401-412 could occur in a different order than is shown. Moreover, although steps 401-412 of FIG. 5 are shown as occurring separately, it should be readily understood that certain of the steps could be combined and occur at the same time. As shown in FIG. 5, to begin formation of the resistive screen 16, a fabric is provided in step 401.

In step 403, the fabric is fused to form the acoustically resistive pattern 20, such that the holes in the fabric are substantially blocked, thereby creating a substantially opaque and impervious layer on the fabric. The fabric could be fused by, for example, applying heat to the portions of the fabric that should have the acoustically resistive pattern 20, or by selectively applying chemical bonding elements to the portions of the fabric that should have the acoustically resistive pattern 20.

As with the examples of FIGS. 2 through 4, in step 408, the fabric is formed into the desired shape for the loudspeaker 10 (e.g., via thermoforming, vacuum forming and/or pressure forming); in step 410, the resistive screen 16 is attached to the acoustic waveguide 14; and in step 412, the electro-acoustic driver 12 is attached to the acoustic waveguide 14. These steps could be completed using the methods previously described in connection with FIGS. 2 through 4.

One or more acoustic sources or acoustic receivers can be coupled to a hollow structure such as an arbitrarily shaped conduit that contains acoustic radiation from the source(s) and conducts it away from the source, or conducts acoustic energy from outside the structure through the structure and to the receiver. The structure has a perimeter wall that is constructed and arranged to allow acoustic energy to leak through it (out of it or into it) in a controlled manner. The perimeter wall forms a 3D surface in space. Much of the following discussion concerns a directionally radiating acoustic device. However, the discussion also applies to directionally receiving acoustic devices in which receivers (e.g., microphone elements) replace the acoustic sources. In a receiver, radiation enters the structure through the leaks and is conducted to the receiver.

The magnitude of the acoustic energy leaked through a leak (i.e., out of the conduit through the leak or into the conduit through the leak) at an arbitrary point on the perimeter wall depends on the pressure difference between the acoustic pressure within the conduit at the arbitrary point and the ambient pressure present on the exterior of the conduit at the arbitrary point, and the acoustic impedance of the perimeter wall at the arbitrary point. The phase of the leaked energy at the arbitrary point relative to an arbitrary reference point located within the conduit depends on the time difference between the time it takes sound radiated from the source into the conduit to travel from the source through the conduit to the arbitrary reference point and the time it takes sound to travel through the conduit from the source to the selected arbitrary point. Though the reference point could be chosen to be anywhere within the conduit, for future discussions the reference point is chosen to be the location of the source such that the acoustic energy leaked through any point on the conduit perimeter wall will be delayed in time relative to the time the sound is emitted from the source. For a receiver configured to receive acoustic output from a source located external to the conduit, the phase of the sound received at any first point along the leak surface relative to any second point along the leak surface is a function of the relative difference in time it takes energy emitted from the external acoustic source to reach the first and second points. The relative phase at the receiver for sounds entering the conduit at the first and second points depends on the relative time delay above, and the relative distance within the conduit from each point to the receiver location.

Figure 7A:
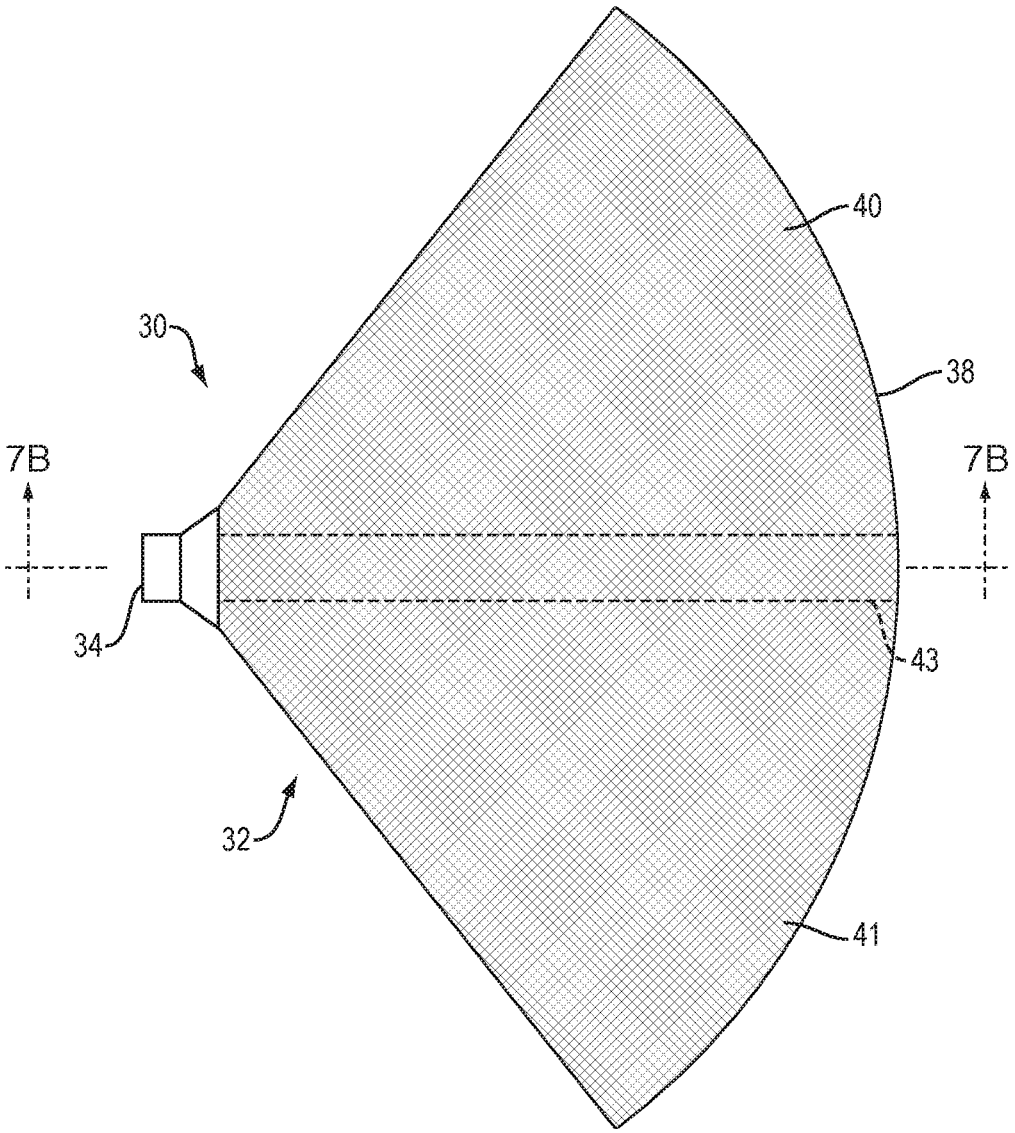
FIG. 7A is a plan view of a directionally radiating acoustic device and FIG. 7B is a cross-section taken along line 7B-7B.
Figure 7B:
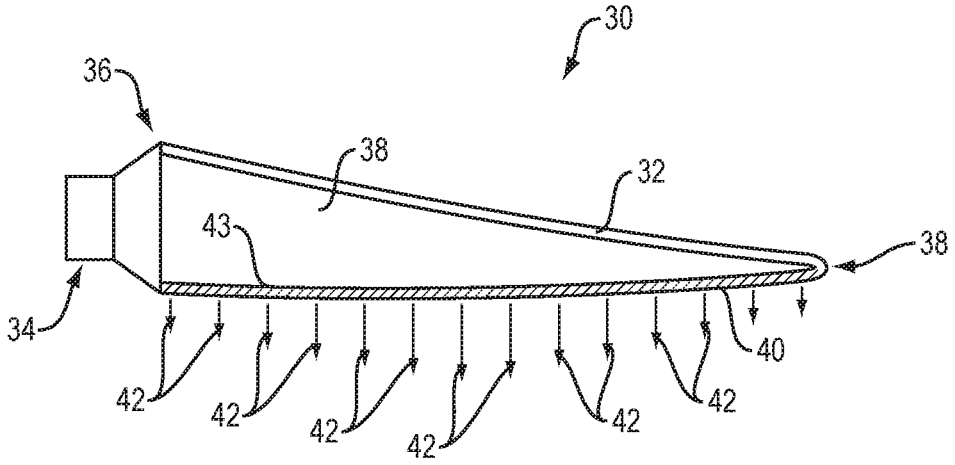

The shape of the structure's perimeter wall surface through which acoustic energy leaks (also called a "radiating section" or "radiating portion" herein) is arbitrary. In some examples, the perimeter wall surface (radiating portion) may be generally planar. One example of an arbitrarily shaped generally planar wall surface 40 is shown in FIGS. 7A and 7B. The cross hatched surface 41 of wall 40 represents the radiating portion through which acoustic volume velocity is radiated.

Directionally radiating acoustic device 30 includes structure or conduit 32 to which loudspeaker (acoustic source) 34 is acoustically coupled at proximal end 36; the source couples to the conduit along an edge of the 2D projected shape of the conduit. There could be two or more acoustic sources rather than the one shown. Radiating portion 41 in this non-limiting example is the bottom surface of conduit 32, but the radiating surface could be on the top or on both the top and bottom surfaces of generally planar conduit 32. Arrows 42 depict a representation of acoustic volume velocity directed out of the conduit 32 through leak section 43 in bottom wall 40 into the environment. The length of the arrows is generally related to the amount of volume velocity emitted. The amount of volume velocity emitted to the external environment may vary as a function of distance from the source. For use as a receiver, source 34 would be replaced with one or more microphone elements, and the volume velocity would be received into rather than emitted from radiating portion 41.

Leak section 43 is a portion of the radiating portion 41 of wall 40, and is depicted extending along the direction of sound propagation from speaker 34 toward conduit periphery 38. The following discussion of leak section 43 is also applicable to other portions of the radiating portion 41 of wall 40. It is useful to only consider what is happening in section 43 for purposes of discussion, to better understand the nature of operation of the examples disclosed herein. Leak section 43 is depicted as continuous, but could be accomplished by a series of leaks aligned along the sound propagation direction (or sound reception direction for a receiver). Leak section 43 is shown in FIG. 7A as a rectangular strip extending in a straight line away from the location of speaker 34. This is a simplification to help illustrate the lengthwise extent of the radiating portion 41 of wall 40. In general, a significant or in some examples the entire portion of surface 40 may be radiating, as illustrated by the cross-hatching. In some examples, the portion of surface 40 incorporating a leak may vary as a function of distance or angle or both from the location of a source (or sources in examples with more than one source). The location, size, shape, acoustical resistance and other parameters of the leaks are variables that can be taken into account to achieve a desired result, including but not limited to a desired directionality of sound radiation or sound reception.

Figure 8A:
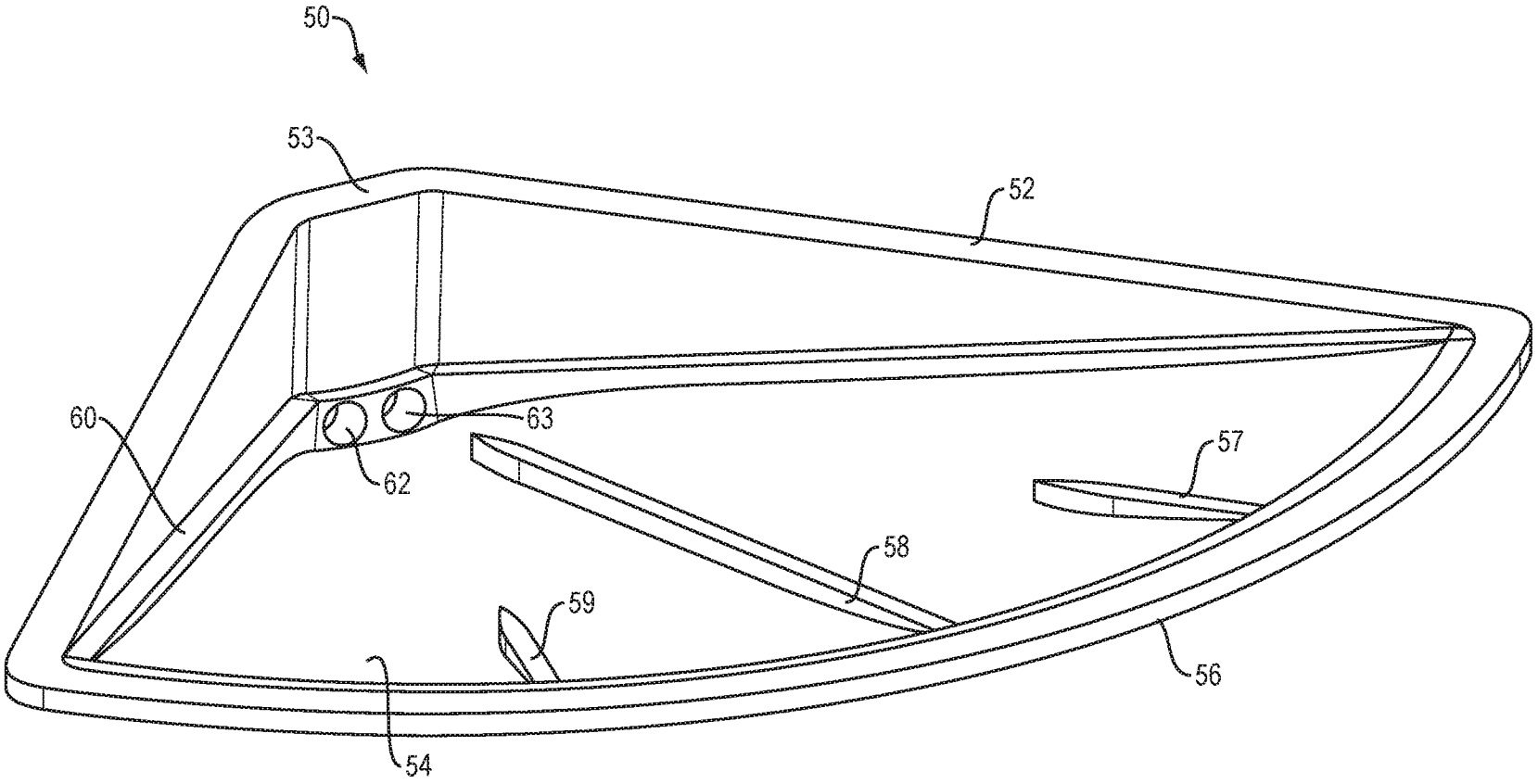
FIGS. 8A and 8B are top and rear perspective views, respectively, of a housing for a directional receiving device.
Figure 8B:
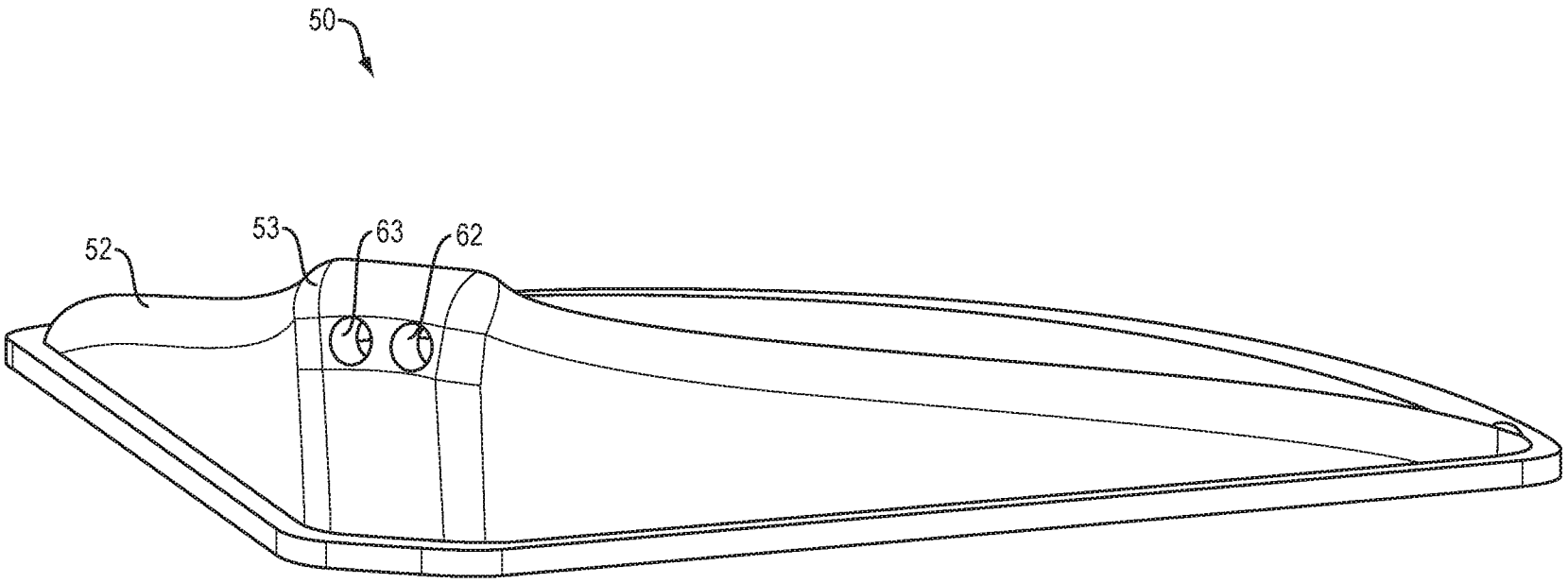

An exemplary end fire shell acoustic receiver is shown in FIGS. 8A and 8B. Device 50 comprises housing 52 with openings 62 and 63 that each hold a microphone element (not shown). There can be one, two or more microphone elements. Device 50 has a generally ¼ circle (i.e., generally circular segment) shape or profile, subtending an angle of about 90 degrees. End/sidewalls 53 allow the device to be pitched downward, but this is not a necessary feature. Peripheral flange 56 provides rigidity. Ribs 57-59 that project above solid wall 54, along with interior shelf 60, define a surface on which a resistive screen (not shown, but such as the radiating surface 70 depicted in FIGS. 9A-9C) is located. The screen accomplishes the leaks. The screen can be of any type, including but not limited to those described herein. The conduit is formed between this screen and wall 54. As can be seen, from peripheral wall 56 to the microphone location the depth of the conduit progressively increases, but the depth could be consistent or could progressively decrease, or could have a different profile.

Figure 9A:
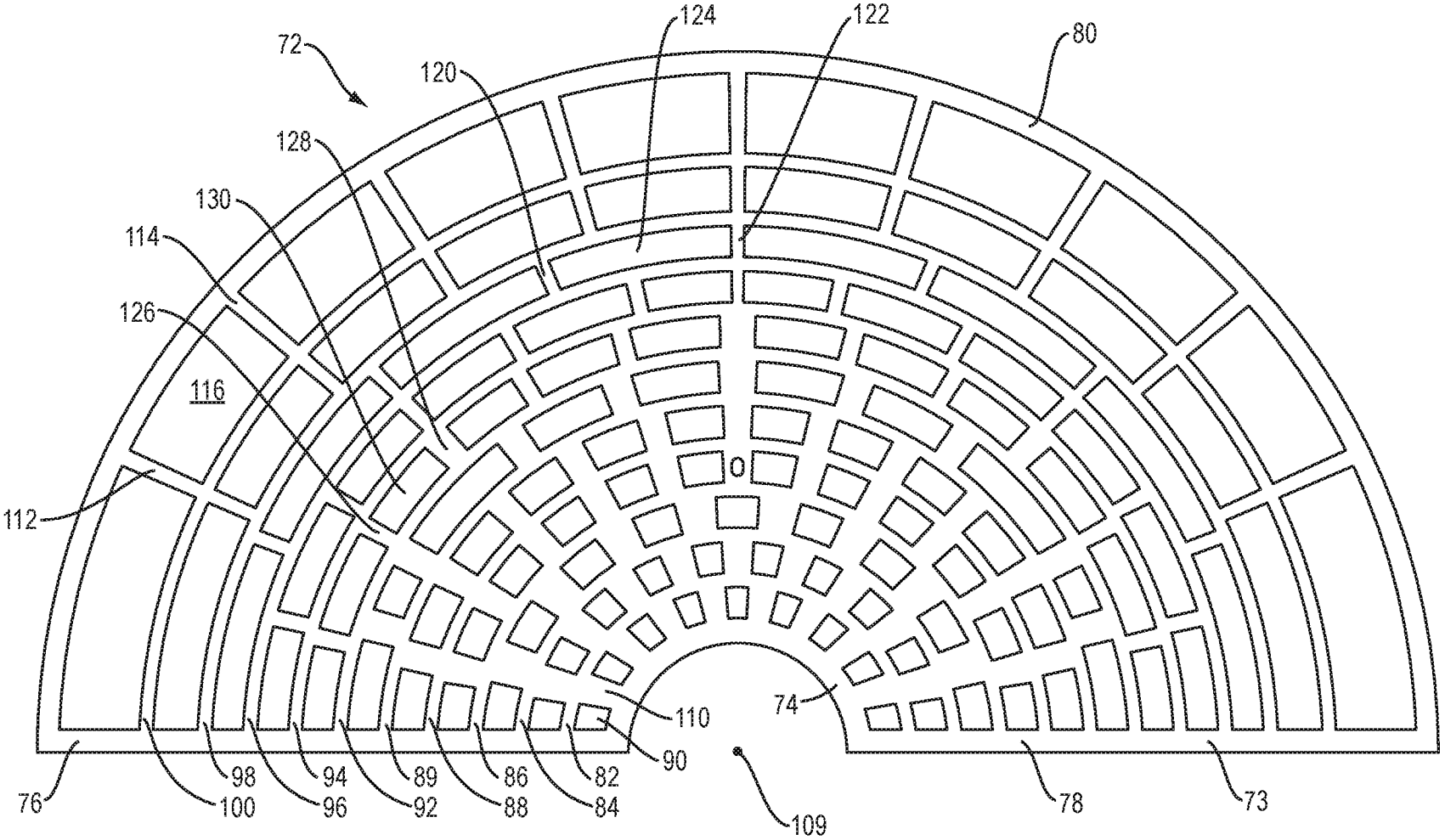
FIG. 9A is a top view of a thin sheet for a radiating surface.
Figure 9B:
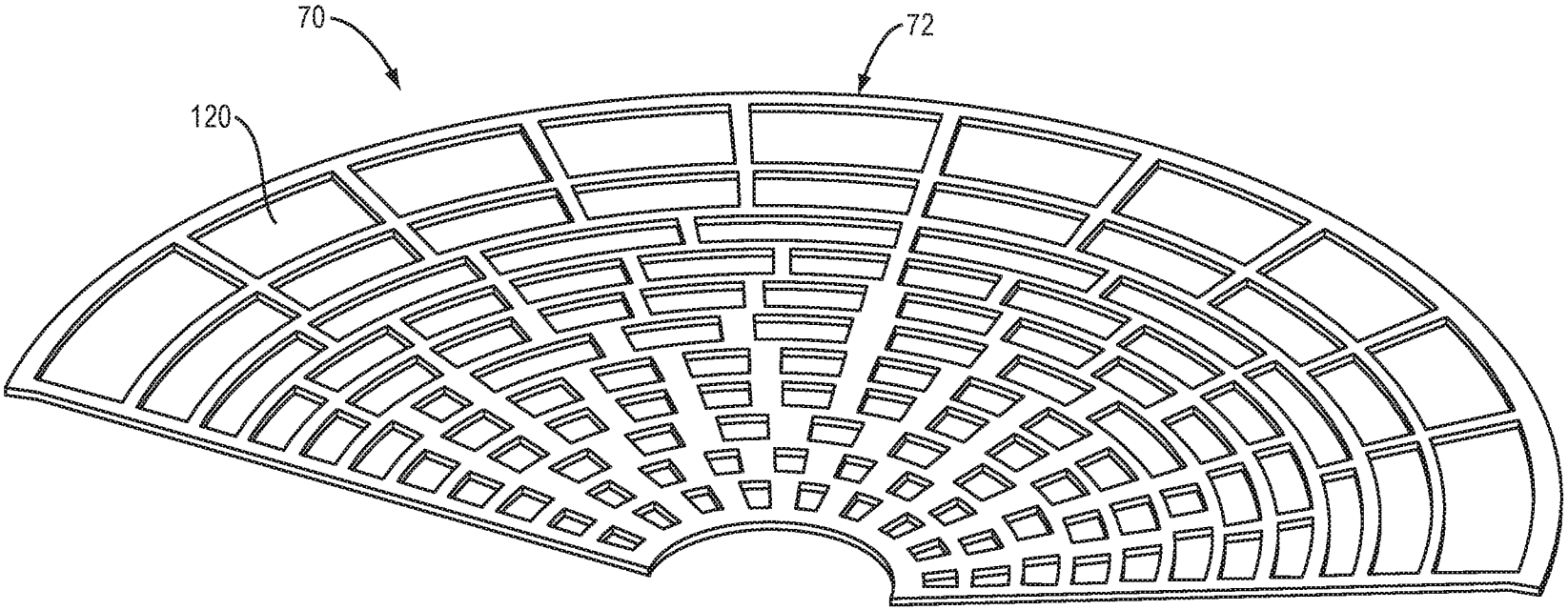
FIG. 9B is a top view of a radiating surface that includes the thin sheet of FIG. 9A.
Figure 9C:
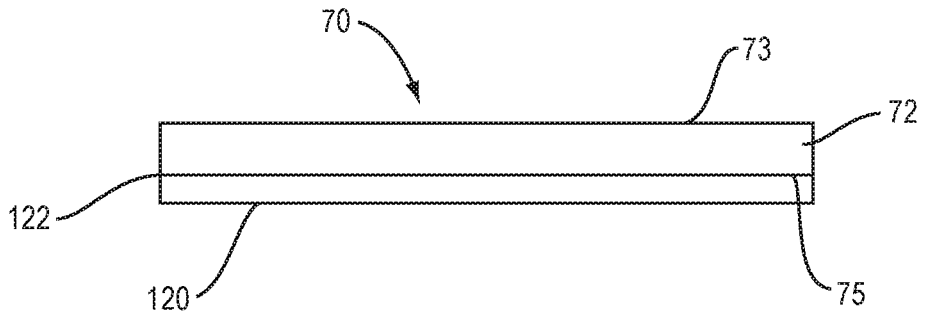
FIG. 9C is an exaggerated schematic side view of the radiating surface of FIG. 9B.

Another example of a radiating surface 70 is depicted in part, and as a whole, in FIGS. 9A, 9B and 9C. Radiating surface 70 comprises thin acoustically-opaque (or highly acoustically resistant) sheet 72 (FIG. 9A) with a number of openings (only openings 90, 116, 124 and 130 are numbered in FIG. 9A, simply for convenience of illustration). The openings are through the sheet thickness, between top surface 73 and lower surface 75. Sheet 72 generally has the same shape as the surface of the conduit that it covers so as to define the radiating portion of the conduit. In this non-limiting example sheet 72 has a generally one-half circular segment shape defined by outer perimeter walls 74, 76, 78 and 80. Arc-shaped support ribs 82, 84, 86, 88, 89, 92, 94, 96, 98 and 100 each extend from side 76 to side 78. Support ribs, if present in the thin sheet, do not need to be arc shaped and do not need to extend from side to side. Generally radial support ribs that generally lie along radii from center point 109 (only ribs 110, 112, 114, 120, 122, 126 and 128 are numbered in FIG. 9A, simply for convenience of illustration) are connected between the arc-shaped support ribs. The support ribs (or support structures that are not rib-shaped) in total define the openings while maintaining the necessary stiffness. In this non-limiting example the area of sheet 72 includes the outer perimeter walls, the inner support ribs, and the openings. To further illustrate the relationship of these elements, opening 116 is defined between outer wall 80, rib 100 and ribs 112 and 114. Opening 124 is defined between ribs 96, 98, 120 and 122. Opening 130 is defined between ribs 92, 94, 126 and 128. Opening 90 is defined between inner wall 74, peripheral wall 76, rib 82 and rib 110. More generally, since the openings are the features of the sheet that contribute to leaks, sheet material remaining after the openings have been created may comprise ribs or may have other shapes, such shapes not being critical to the operation of the radiating surface. Where the thin sheet has a generally circular segment shape, the openings will typically but not necessarily be generally arc shaped and the ribs will generally but not necessarily be arc shaped and fully or partially radial.

Sheet 72 is typically made from a thin sheet of plastic, metal or other material that is sufficiently strong to span the radiating portion of the acoustic device without sagging in a way that detrimentally affects the function of the device, and that is also effectively acoustically opaque. In one non-limiting example sheet 72 is a 1 mm thick sheet of polycarbonate or polyethylene terephthalate (PET) or another plastic. The openings can be created in any desired fashion such as by die cutting, laser cutting, or machining as three non-limiting examples. The sheet should be sufficiently thin that it does not substantially affect the acoustic performance of the openings. For example, it should not be so thick that the openings act like ports.

At least parts of at least some of the openings in sheet 72 are partially or fully covered by a cover material that has a greater acoustic resistance than the acoustic resistance of the openings (which is typically very low or zero). In one non-limiting example cover material 120, shown in FIGS. 9B and 9C, is a sheet of the approximately 1,000 Rayl Saatifil® Polyester PES 10/3 material described above. Other woven or non-woven materials can be used, some examples of which are described above. Other possibilities include very thin solid sheets with patterns of holes that accomplish the desired acoustic resistance or pattern of graded acoustic resistances. The cover material 120 can cover the entire bottom surface 75 of sheet 72 (as shown in FIG. 9C), or can be arranged in other manners to cover some or all of some or all of the openings in sheet 72. If the radiating surface does not lay flat in use in the directional acoustic device but instead is bent, then the fabric (mainly for aesthetic reasons) is preferably on the side that is in tension so the fabric is in tension and thus is less likely to fold or bunch.

Radiating surface 70 can be fabricated as follows. A 1 mm thick sheet of polycarbonate is covered on one surface (side 75 in this case) with a pressure sensitive adhesive 122 (FIG. 9C). The sheet is then die cut to create the openings. The Saatifil fabric is then adhered to the sheet via the adhesive. The fabric covers all of or substantially all of side 75 of sheet 72.

As described above, other materials could be used for the thin sheet. Also, other types of adhesives could be used such as an RTV or other. The cover material (e.g., the fabric) could optionally cover some or all of only some of the openings in the thin sheet. The cover material could comprise one sheet of material or two or more portions of material that were separately coupled to the thin sheet. The cover material could be coupled to the thin sheet in ways other than via an adhesive, such as with mechanical fasteners, for example.

A number of implementations have been described. Nevertheless, it will be understood that additional modifications may be made without departing from the scope of the inventive concepts described herein, and, accordingly, other embodiments are within the scope of the following claims.

What is claimed is:

1. A directional acoustic device, comprising:

an acoustic source or an acoustic receiver; and a conduit to which the acoustic source or acoustic receiver is acoustically coupled and within which acoustic energy travels in a propagation direction from the acoustic source or to the acoustic receiver, wherein the conduit has a radiating portion that has a radiating surface with leak openings that define controlled leaks through which acoustic energy radiated from the source into the conduit can leak to the outside environment or through which acoustic energy in the outside environment can leak into the conduit;

wherein the radiating surface comprises a thin sheet with a plurality of openings through the sheet, and a cover material with a greater acoustic resistance than an acoustic resistance of an opening, where the cover material covers at least parts of at least some of the openings, to define a plurality of controlled acoustic leaks into or out of the conduit, wherein any openings that are partially or fully covered by the cover material are covered by substantially the same cover material.

2. The directional acoustic device of claim 1, wherein the cover material comprises an open weave material.

3. The directional acoustic device of claim 2, wherein the open weave material comprises a fabric material.

4. The directional acoustic device of claim 2, wherein the open weave material has an acoustic resistance of approximately 1,000 Rayls.

5. The directional acoustic device of claim 1, wherein the cover material has an acoustic resistance of approximately 1,000 Rayls.

6. The directional acoustic device of claim 1, wherein the thin sheet is substantially acoustically opaque.

7. The directional acoustic device of claim 1, wherein the thin sheet comprises a plastic sheet.

8. The directional acoustic device of claim 7, wherein the plastic sheet comprises a polycarbonate material.

9. The directional acoustic device of claim 1, wherein the thin sheet has a generally circular segment shape.

10. The directional acoustic device of claim 9, wherein at least some of the openings through the sheet are generally arc-shaped.

11. The directional acoustic device of claim 9, wherein the thin sheet comprises a plurality of generally arc-shaped support ribs.

12. The directional acoustic device of claim 11, wherein the thin sheet has a width and at least some of the support ribs extend across at least most of the width.

13. The directional acoustic device of claim 1, wherein the cover material is adhered to the thin sheet.

14. The directional acoustic device of claim 13, wherein the cover material is adhered to the thin sheet with a pressure-sensitive adhesive.

15. The directional acoustic device of claim 13, wherein the cover material fully covers all of the openings through the sheet.

16. The directional acoustic device of claim 1, wherein the cover material fully covers all of the openings through the sheet.

17. The directional acoustic device of claim 1, wherein the radiating surface is mounted to the conduit such that the radiating surface defines an outer surface of the directional acoustic device.

18. The directional acoustic device of claim 17, wherein the cover material is in tension.

19. A directional acoustic device, comprising:

an acoustic source or an acoustic receiver; and a conduit to which the acoustic source or acoustic receiver is acoustically coupled and within which acoustic energy travels in a propagation direction from the acoustic source or to the acoustic receiver, wherein the conduit has a radiating portion that has a radiating surface with leak openings that define controlled leaks through which acoustic energy radiated from the source into the conduit can leak to the outside environment or through which acoustic energy in the outside environment can leak into the conduit;

wherein the radiating surface comprises a thin acoustically opaque plastic sheet with a top and bottom surface and plurality of openings through the sheet from the top to the bottom surface, and an open weave fabric cover material with a greater acoustic resistance than an acoustic resistance of an opening adhered to the top or bottom surface of the sheet and fully covering at least most of the openings, to define a plurality of controlled acoustic leaks into or out of the conduit, wherein any openings that are covered are covered by substantially the same open weave fabric cover material.

20. The directional acoustic device of claim 19, wherein the cover material essentially fully covers the top or bottom surface of the sheet.

* * * * *